US009099069B2

(12) United States Patent
Shinoda et al.

(10) Patent No.: US 9,099,069 B2
(45) Date of Patent: Aug. 4, 2015

(54) SIGNAL PROCESSING DEVICE

(71) Applicant: YAMAHA CORPORATION, Hamamatsu, Shizuoka-ken (JP)

(72) Inventors: Ryo Shinoda, Hamamatsu (JP); Ryuichiro Kuroki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 45 days.

(21) Appl. No.: 13/706,950

(22) Filed: Dec. 6, 2012

(65) Prior Publication Data

US 2013/0145922 A1 Jun. 13, 2013

(30) Foreign Application Priority Data

Dec. 9, 2011 (JP) ..... 2011-270035

(51) Int. Cl.
*G10H 1/00* (2006.01)
*G10H 1/12* (2006.01)
*G10H 3/18* (2006.01)

(52) U.S. Cl.
CPC ..... *G10H 1/125* (2013.01); *G10H 3/186* (2013.01); *G10H 2210/031* (2013.01)

(58) Field of Classification Search
CPC ... G10H 3/26; G10H 2220/525; G10H 3/186; G10H 2250/451; G10H 2250/115; G10H 2210/271; G10H 2250/111; G10H 3/22; G10H 2210/155; G10H 2250/075; G10H 2250/121; G10H 2250/145; G10H 2250/495; G10H 7/008
See application file for complete search history.

(56) References Cited

U.S. PATENT DOCUMENTS 5,498,835 A * 3/1996 Ichiki ..... 84/630
6,320,113 B1 * 11/2001 Griffin et al. ..... 84/738
6,448,488 B1 * 9/2002 Ekhaus et al. ..... 84/735
(Continued)

FOREIGN PATENT DOCUMENTS

CN 101793873 A 8/2010
EP 1 883 064 A1 1/2008
(Continued)

OTHER PUBLICATIONS

Firth, "Physics of the Guitar at the Helmholtz and First Top-Plate Resonances", J. Acoust. Soc. Am., Feb. 1, 1997, vol. 61, No. 2, pp. 588-593 (six (6) sheets).
(Continued)

*Primary Examiner* — Marlon Fletcher
(74) *Attorney, Agent, or Firm* — Crowell & Moring LLP

(57) ABSTRACT

A signal processing device is designed to automatically calculate a transfer characteristic representing sound-box resonance of a guitar due to acoustic excitation of vibration which may occur due to white noise. White noise emitted toward the guitar causes vibration propagating via strings so as to produce an audio signal via a pickup. A transfer characteristic is calculated based on an audio signal and a white-noise signal. A filter performs convolution, using the transfer characteristic, on audio data representing user's playing sound of the guitar, thus reproducing sound-box resonance indicating distinctive peaks which may appear in a low-frequency range of guitar's sound. It is possible to store a plurality of transfer characteristics in memory, whereby any user may be allowed to select a desired transfer characteristic among transfer functions stored in memory or to utilize a transfer characteristic actually calculated by the signal processing device.

11 Claims, 11 Drawing Sheets

(56) References Cited

U.S. PATENT DOCUMENTS

| | | | | |
|---|---|---|---|---|
| 6,610,917 | B2 * | 8/2003 | Ludwig | 84/726 |
| 6,689,947 | B2 * | 2/2004 | Ludwig | 84/721 |
| 6,747,202 | B2 * | 6/2004 | Kuroki | 84/737 |
| 7,190,796 | B1 * | 3/2007 | Kashani | 381/71.1 |
| 2005/0045027 | A1 | 3/2005 | Celi et al. | |
| 2008/0134867 | A1 | 6/2008 | Kemper | |
| 2009/0173218 | A1 * | 7/2009 | Kuroki | 84/629 |
| 2011/0226119 | A1 | 9/2011 | Shinoda | |
| 2012/0294457 | A1 * | 11/2012 | Chapman et al. | 381/98 |
| 2014/0260906 | A1 * | 9/2014 | Welch | 84/603 |

FOREIGN PATENT DOCUMENTS

| | | | |
|---|---|---|---|
| JP | 5-73039 | A | 3/1993 |
| JP | 2007-71828 | A | 3/2007 |
| JP | 2007-232492 | A | 9/2007 |
| JP | 2009-162997 | A | 7/2009 |
| JP | 2009-288555 | A | 12/2009 |
| JP | 2011-197325 | A | 10/2011 |
| JP | 2011-197326 | | 10/2011 |

OTHER PUBLICATIONS

Extended European Search Report dated Mar. 5, 2013 (nine (9) sheets).

Firth, "Physics of the Guitar at the Helmholtz and First Top-Plate Resonances", J. Acoust. Soc. Am., Feb. 1, 1977, vol. 61, No. 2, pp. 588-593 (six (6) sheets).

English abstract of Document B3 (CN 101793873 A) previously filed on Oct. 22, 2014 (one (1) page).

Chinese Office Action dated Aug. 29, 2014, with English translation (fifteen (15) pp.).

Japanese Office Action dated May 12, 2012, with English translation (Four (4) pages).

* cited by examiner

| TYPE | TRANSFER FUNCTION |
|---|---|
| G0 | Php(t) |
| G1 | Bhm(t)_1 |
| G2 | Bhm(t)_2 |
| G3 | Bhm(t)_3 |
| G4 | Bhm(t)_4 |
| G5 | Bhm(t)_5 |

SIGNAL PROCESSING DEVICE

BACKGROUND OF THE INVENTION

1. Field of the Invention

The present invention relates to a signal processing device which processes audio signals based on resonance components of resonators, such as sound boxes, shells, and sound boards of musical instruments.

The present application claims priority on Japanese Patent Application No. 2011-270035, the content of which is incorporated herein by reference.

2. Description of the Related Art

It is known that stringed instruments such as guitars can be equipped with electronic configurations which convert vibration propagating through strings into electric signals by use of pickups configured of piezoelectric elements. Electric signals may be amplified and then reproduced via speakers, thus producing sound (e.g. guitar sound) at a high volume. Sound reproduced based on electric signals detected by pickups may not substantially include resonance components which occur in sound boxes of guitars. For this reason, sound directly reproduced based on electric signals may convey an impression, in which the reproduced sound is heard differently from sound actually produced by an acoustic guitar, to listeners. To overcome this drawback, Patent Literatures 1 and 2 disclose a signal processing device which carries out convolution using an FIR (Finite Impulse Response) filter on electric signals, thus applying sound-box resonance of a guitar to reproduced sound.

The technology of Patent Literatures 1 and 2 is designed to carry out convolution so as to apply electric signals, corresponding to vibration propagating through strings of a stringed instrument with sound-box resonance sound of another stringed instrument, thus improving reproducibility of sound-box resonance sound. This technology needs a preliminary operation for analyzing impulse response using an impulse hammer in order to determine a transfer function representing a parameter for use in convolution in advance. Additionally, this technology needs an additional configuration such as a microphone for detecting sound. It is possible to improve convenience for users if a resonance component of a stringed instrument can be obtained without implementing a preliminary operation and an additional configuration.

CITATION LIST

Patent Literature

Patent Literature 1: Japanese Patent Application Publication No. 2011-197326

Patent Literature 2: U.S. Patent Application Publication No. US 2011/0226119 A1

SUMMARY OF THE INVENTION

It is an object of the present invention to provide a signal processing device for processing audio signals (e.g. musical tone signals), which is able to determine a transfer function representing sound-box resonance of a musical instrument based on acoustic excitation of vibration in a musical instrument.

It is another object of the present invention to provide a signal processing device for applying a resonance component, caused by a resonating body of a musical instrument, to an audio signal of a musical instrument without implementing an additional configuration such as an impulse hammer and a microphone.

The present invention is directed to a signal processing device which is designed to calculate a transfer characteristic (e.g. a transfer function) representing a resonance characteristic of a musical instrument based on a test signal which is fed back from the musical instrument receiving a test sound.

The signal processing device may include an acquisition part which is configured to acquire an audio signal from a musical instrument; a parameter setting part which is configured to set a parameter based on the transfer characteristic; and a signal processor which is configured to perform convolution using the parameter on the audio signal.

The signal processing device may further include a transmitter which is configured to produce the test signal representing the test sound emitted toward the musical instrument. Additionally, the signal processing device may further include a speaker which is configured to produce the test sound based on the test signal.

Moreover, the musical instrument may include a vibrator causing vibration, a sound box (or a body) resonating to the vibration, and a transducer which is configured to convert vibration into an audio signal. Herein, the calculation part calculates a transfer characteristic simulating sound-box resonance of the musical instrument based on an audio signal and a test signal representing a test sound emitted toward the musical instrument.

Specifically, when a guitar including strings, a body (or a sound box), and a pickup is equipped with the signal processing device, it is possible to determined a transfer function based on white noise (i.e. test sound) emitted toward the guitar, thus reproducing resonance due to acoustic excitation of vibration which occurs in the guitar receiving white noise. Herein, a filter (e.g. an FIR filter) performs convolution using a transfer function, calculated by the calculation part based on an audio signal due to acoustic excitation of vibration, so as to produce audio data, thus reproducing sound-box resonance of the guitar.

The present invention is not necessarily applied to stringed instruments but applicable to any types of musical instruments, such as pianos, thus reproducing sound-board resonance other than sound-box resonance.

The present invention is able to determine a transfer function for applying a resonance component, caused by a resonating body of a musical instrument, to an audio signal of a musical instrument without implementing an additional configuration such as an impulse hammer and a microphone.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
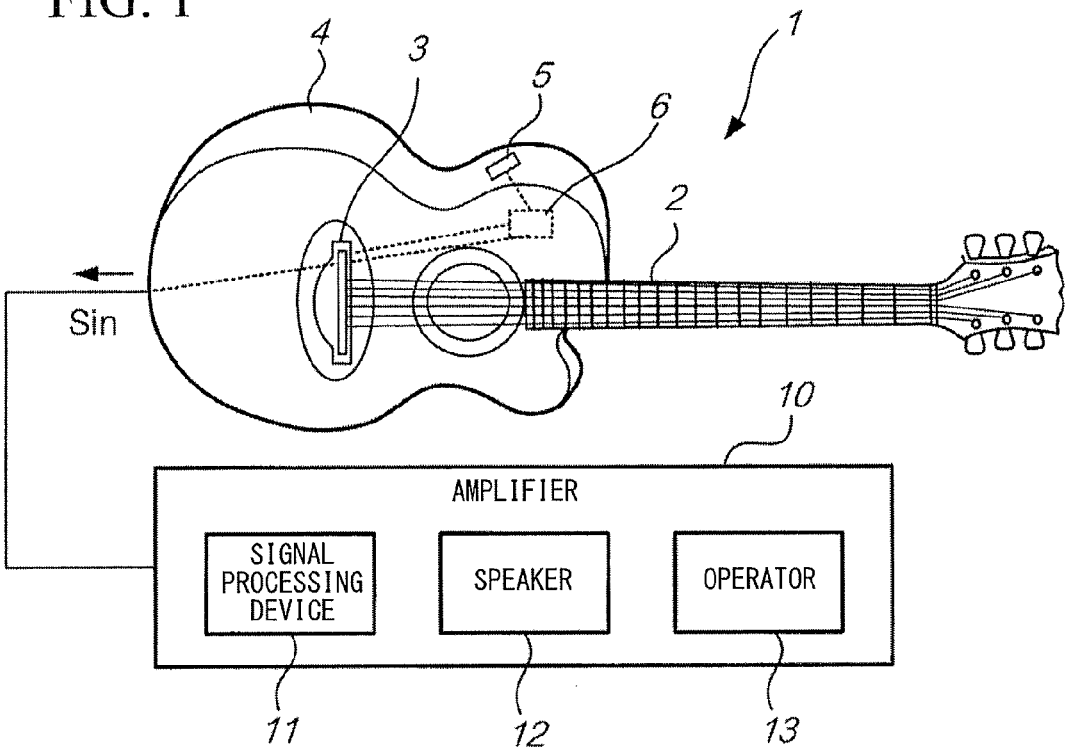
FIG. 1 is an illustration of a guitar equipped with an amplifier including a signal processing device according to a preferred embodiment of the present invention.

FIG. 1 shows the exterior appearance of a guitar 1 connectible to an amplifier 10 according to a preferred embodiment of the present invention. Specifically, the guitar 1 is an electric acoustic guitar equipped with strings 2, a pickup 3, a body (or a sound box) 4, an operator 5, and a signal processor 6. Additionally, the guitar 1 is equipped with a terminal for transmitting an audio signal Sin output from the signal processor 6. When the amplifier 10 is connected to the terminal of the guitar 1 via a shielding wire, the guitar 1 may supply an audio signal Sin to the amplifier 10, thus producing sound.

The strings 2 are vibrators which may vibrate themselves in response to external force applied thereto. When a user (e.g. a guitar player) plays the guitar 1 so that the strings 2 vibrate by themselves, the pickup 3 configured of a piezoelectric element converts vibration, which propagates through the strings 2 and then reaches the pickup 3, into an electric signal (i.e. an audio signal Sin). Upon receiving a user's operation, the operator 5 (which may include a rotary switch and an operation button) produces operation information representing the user's operation. The operator 5 may further include a display for displaying a menu on screen. Upon receiving an audio signal Sin from the pickup 3 and the operation information from the operator 5, the signal processor 6 adjusts the level of the audio signal Sin and the operation information so as to output them via the terminal.

Next, the configuration and operation of the amplifier 10 will be described in connection with the processing at a normal play mode selected by a user. The amplifier 10 includes a signal processing device 11, a speaker 12, and an operator 13. In the amplifier 10, the signal processing device 11 carries out signal processing on an audio signal Sin output from the pickup 3 of the guitar 1. Subsequently, the amplifier 10 amplifies the processed audio signal and then supplies it to the speaker 12, thus producing sound based on the amplified audio signal. The speaker 12 is an example of a sound reproducer which converts an electric signal into sound. Using the operator 13 including a rotary switch and an operation button, a user is able to adjust an EQ (Equalizer) function executable on the signal processing device 11.

Next, the processing of the amplifier 10 will be described with respect to a resonance mode for applying a resonance component of the body 4 of the guitar 1 (i.e. a sound-box resonance component) to sound reproduced by the amplifier 10. A preliminary operation should be carried out before a user plays the guitar 1. That is, the user operates the operator 13 to emit a test sound (e.g. white noise) from the speaker 12 in a front direction of the guitar 1. Although the present embodiment uses white noise, it is possible to employ other measurement factors such as an impulse signal, a sweep signal, random noise, and pink noise. Specifically, it is necessary to use sound with an audio frequency range appearing in a certain time. The guitar 2 may resonate to white noise with the strings 2, thus causing vibration. The pickup 3 converts the vibration of the strings 2, due to white noise, into an audio signal Sin, which is supplied to the amplifier 10. Hereinafter, the vibration of the strings 2 due to white noise will be referred to as acoustic excitation of vibration. The amplifier 10 forwards the audio signal Sin to the signal processing device 11. The signal processing device 11 performs analog-to-digital conversion on the audio signal Sin, thus producing audio data Sa. The signal processing device 11 produces a transfer function representing acoustic excitation of vibration based on audio data Sa. Subsequently, the signal processing device 11 performs convolution using the transfer function on the audio signal Sin. Thus, it is possible to improve reproducibility of resonance sound of the body 4 of the guitar 1.

Figure 2:
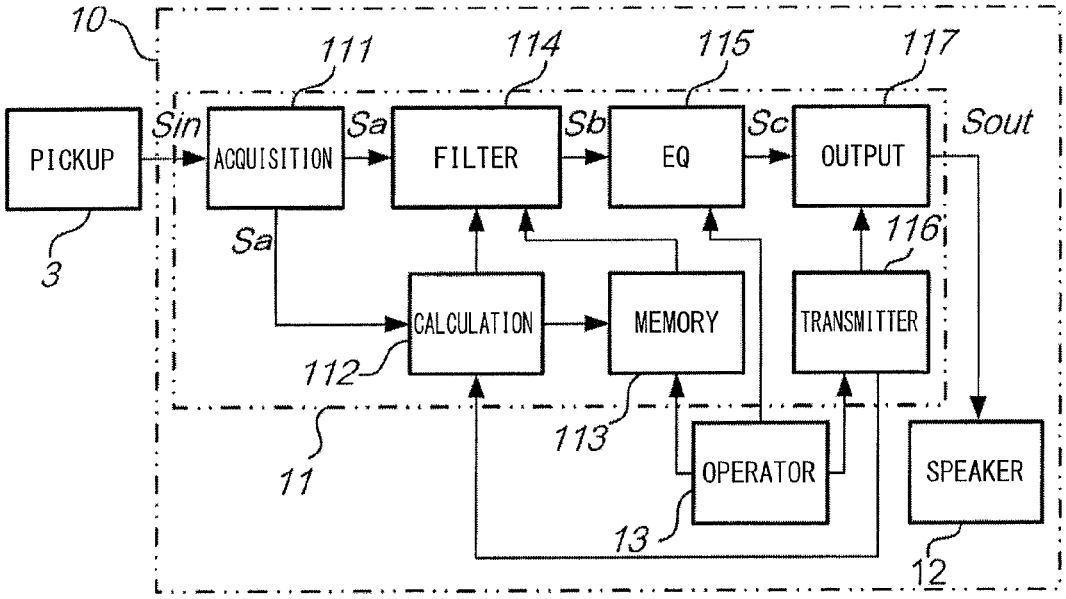
FIG. 2 is a block diagram of the amplifier including the constituent elements of the signal processing device.

FIG. 2 is a block diagram of the amplifier 10 including the constituent elements of the signal processing device 11. The signal processing device 11 includes an acquisition part 111, a calculation part 112, a memory 113, a filter (e.g. an FIR filter) 114, an EQ part 115, a transmitter 116, and an output part 117. The following description refers to a main path of processing an audio signal Sin of the guitar 1 played by a user and then refers to a secondary path of processing acoustic excitation of vibration. When a user plays the guitar 1, the acquisition part 111 acquires an audio signal Sin produced by the pickup 3 and then performs analog-to-digital conversion on the audio signal Sin so as to produce audio data Sa, which is supplied to the calculation part 112 and the filter 114. The memory 113 (e.g. a non-volatile memory) stores a transfer function which is calculated by the calculation part 112. The filter 114 performs convolution, using the transfer function stored in the memory 113 as a parameter, on the audio data Sa, thus producing audio data Sb. As the filter 114, it is possible to use various types of devices performing filtering operations based on transfer characteristics. For example, it is possible to use an FIR filter, an IIR filter, a device multiplying an input signal by a transfer characteristic in a frequency domain, or a device performing processing using a characteristic approximating (or simulating) a part of a transfer characteristic in a frequency domain. As the processing using a characteristic approximating a part of a transfer characteristic in a frequency domain, it is possible to employ processing solely amplifying a peak component of a transfer characteristic or processing using an envelope of a transfer characteristic. In this connection, a transfer function may exemplify a transfer characteristic. The EQ part 115 (e.g. a parametric equalizer, a graphic equalizer) performs equalization based on its setting. Based on the setting, the EQ part 115 performs equalization on audio data Sb, thus producing audio data Sc. The user may operate the operator 13 so as to determine the setting of the EQ part 115. The output part 117 performs digital-to-analog conversion on the audio data Sc output from the EQ part 115 and then amplifies the audio data Sc at a predetermined amplification factor, thus producing an audio signal Sout based on the audio signal Sin. The signal processing device 11 supplies the audio signal Sout to the speaker 12. The user operates the operator 13 to set the amplification factor.

Next, the secondary path of processing acoustic excitation of vibration will be described in detail. First, the user operates the operator 13 to control the transmitter 116, thus outputting a test signal (e.g. a white-noise signal). The output part 117 performs digital-to-analog conversion on the white-noise signal and then amplifies the white-noise signal at the predetermined amplification factor, thus producing an audio signal Sout based on the white-noise signal. The audio signal Sout is supplied to the speaker 12, thus producing white noise. Upon receiving white noise, the guitar 1 may cause vibration on the strings 2 due to acoustic excitation of vibration. The pickup 3 converts vibration into an audio signal Sin, which is supplied to the amplifier 10. The acquisition part 111 acquires the audio signal Sin produced by the pickup 3 and then performs analog-to-digital conversion on the audio signal Sin, thus producing audio data Sa due to acoustic excitation of vibration. The acquisition part 111 supplies the audio data Sa to the calculation part 112 and the filter 114. Based on the audio data Sa and the white-noise signal output from the transmitter 116, the calculation part 112 calculates a transfer function (mainly representing vibration propagating the body 4 of the guitar 1) serving as a parameter for use in convolution which is performed on the audio data Sa with the filter 114. The memory 113 stores the transfer function calculated by the calculation part 112. The filter 114 performs convolution using a parameter, i.e. the transfer function stored in the memory 113, on the audio data Sa so as to produce audio data Sb due to acoustic excitation of vibration. Instead of directly performing convolution using a transfer function with the filter 114, it is possible to use a parameter representing a peak of frequency in an envelope of a frequency characteristic of a transfer function, calculated by the calculation part 112. In this case, the calculation part 112 may specify a peak of frequency (e.g. peak frequencies f1, f2). The EQ part 115 performs equalization on the audio data Sb so as to produce audio data Sc due to acoustic excitation of vibration. The output part 117 performs digital-to-analog conversion on the audio data Sc and then amplifies the audio data Sc at a predetermined amplification factor, thus producing an audio signal Sout due to acoustic excitation of vibration. Herein, the user may operate the operator 13 (e.g. a selection switch) to prevent either the audio data Sc or the white-noise signal from being incorporated into the audio signal Sout.

Next, the operation of the digital signal processor 11 will be described with reference to FIGS. 3 and 4.

Figure 3:
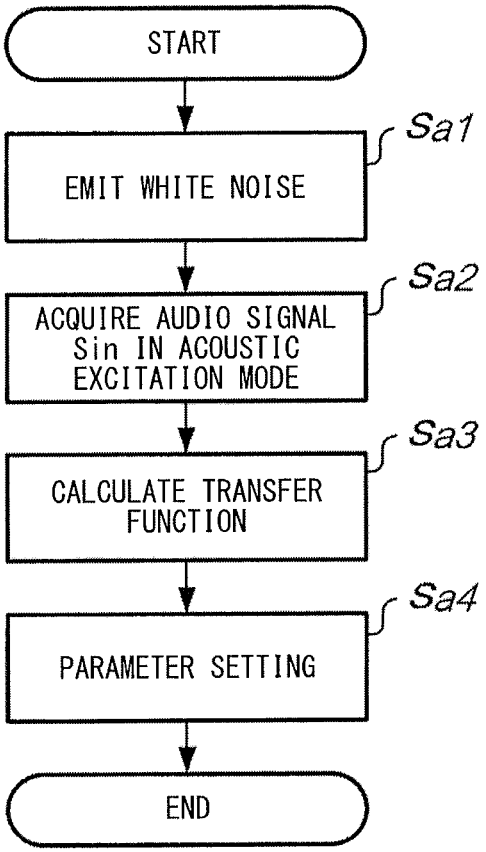
FIG. 3 is a flowchart illustrating a preliminary process for applying a resonance component to an audio signal.

FIG. 3 is a flowchart illustrating a preliminary process for applying a resonance component to an audio signal. When a user operates the operator 13 to emit a white-noise signal via the transmitter 116, the speaker 12 emits white noise toward the guitar 1 (step Sa1). The white-noise signal needs to include an audio frequency range in a certain time; hence, it is possible to use a sweep signal or other signals. Upon receiving white noise from the speaker 12, the pickup 3 of the guitar 1 converts vibration of the strings 2 due to acoustic excitation of vibration into an audio signal Sin. The acquisition part 111 receives the audio signal Sin from the pickup 3 of the guitar 1 (step Sa2). The acquisition part 111 performs analog-to-digital conversion on the audio signal Sin so as to produce audio data Sa. The calculation part 112 calculates a transfer function based on the audio data Sa of the acquisition part 111 and the white-noise signal of the transmitter 116 (step Sa3). The filter 114 sets the transfer function of step Sa3 to a parameter (step Sa4).

Figure 4:
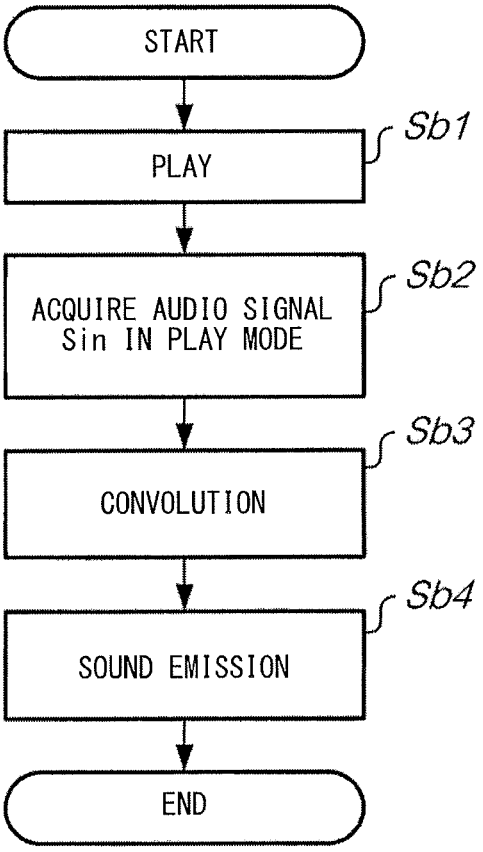
FIG. 4 is a flowchart illustrating a user's play process on the guitar.

FIG. 4 is a flowchart illustrating a user's play process on the guitar 1. First, a user plays the guitar 1 (step Sb1). At this time, the speaker 12 is not allowed to emit white noise when the user does not operate the operator 13. The pickup 3 of the guitar 1 converts vibration of the strings 2 due to user's play into an audio signal Sin. The acquisition part 111 acquires the audio signal Sin from the pickup 3 of the guitar (step Sb2). The acquisition part 111 performs analog-to-digital conversion on the audio signal Sin so as to produce audio data Sa. The filter 114 performs convolution using the transfer function of step Sa3 on the audio data Sa of the acquisition part 111, thus producing audio data Sb (step Sb3). The EQ part 115 corrects the audio data Sb of the filter 114 so as to produce audio data Sc. The output part 117 converts the audio data Sc of the EQ part 115 into an audio signal Sout. The audio signal Sout of the output part 117 is supplied to the speaker 12, which thus emits sound corresponding to user's playing of the guitar 1 (step Sb4).

Figure 5A:
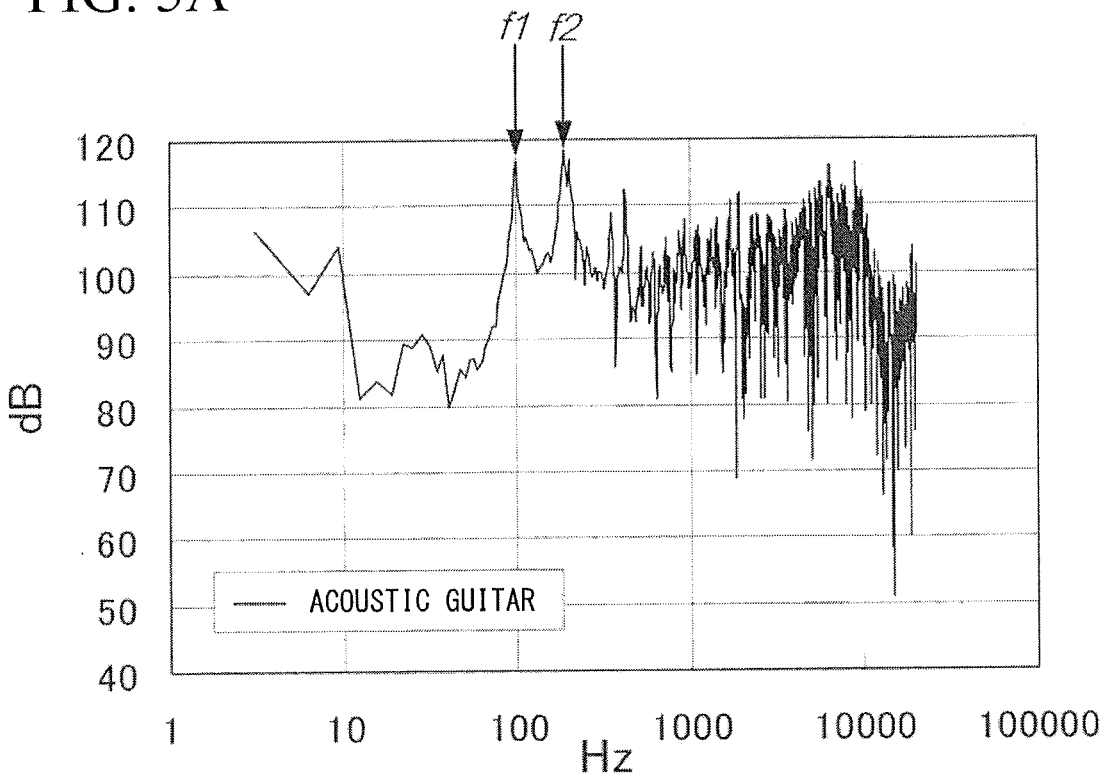
FIG. 5A is a graph showing a frequency characteristic for reproducing resonance sound of an acoustic guitar.
Figure 5B:
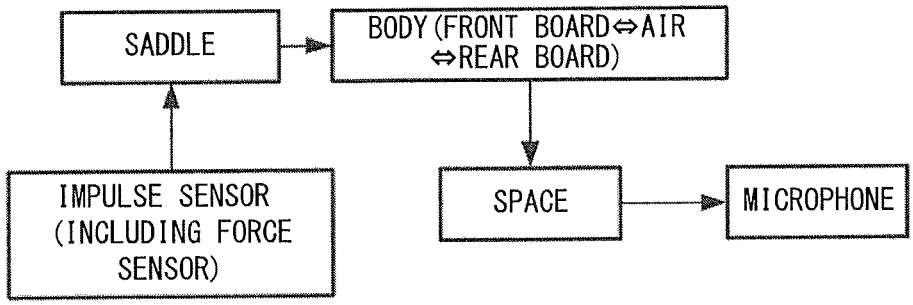
FIG. 5B is a simplified diagram showing a propagation path of resonance sound.

FIGS. 5A and 5B illustrate a frequency characteristic for reproducing resonance on an acoustic guitar. FIG. 5A shows a frequency characteristic of an acoustic guitar including a bridge, a saddle, and a body (or a sound box), and FIG. 5B shows a propagation path of resonance sound. Specifically, when the bridge of an acoustic guitar is struck with an impulse hammer including a force sensor, striking vibration is transmitted through the saddle of the acoustic guitar so that the body of the acoustic guitar can cause resonance sound, which is transmitted through the external space (i.e. the external space surrounding the acoustic guitar). Then, resonance sound is received by a microphone, thus producing an electric signal. The frequency characteristic of FIG. 5A includes a plurality of distinctive peak waveforms, corresponding to sound-box resonance sound of an acoustic guitar, i.e. twin peaks at frequencies f1, f2. In this connection, the number of peak frequencies depends on the type of a musical instrument; hence, a certain musical instrument may involve a single peak frequency or three or more peak frequencies. The peak frequencies f1, f2 may appear in a specific low frequency range from 50 Hz to 350 Hz. In FIG. 5A, the peak frequencies f1, f2 appear at approximately 100 Hz and 200 Hz. These peaks occur due to Helmholtz resonance which may be influenced by the shape of an acoustic guitar's body, and the sound hole of an acoustic guitar. The signal processing device 11 performs signal processing on an audio signal Sin so as to exhibit twin distinctive peaks at frequencies f1, f2. The sound of the frequency characteristic with twin peaks at frequencies f1, f2 may reflect a resonance component caused by the body of a musical instrument (e.g. a guitar).

Figure 6A:
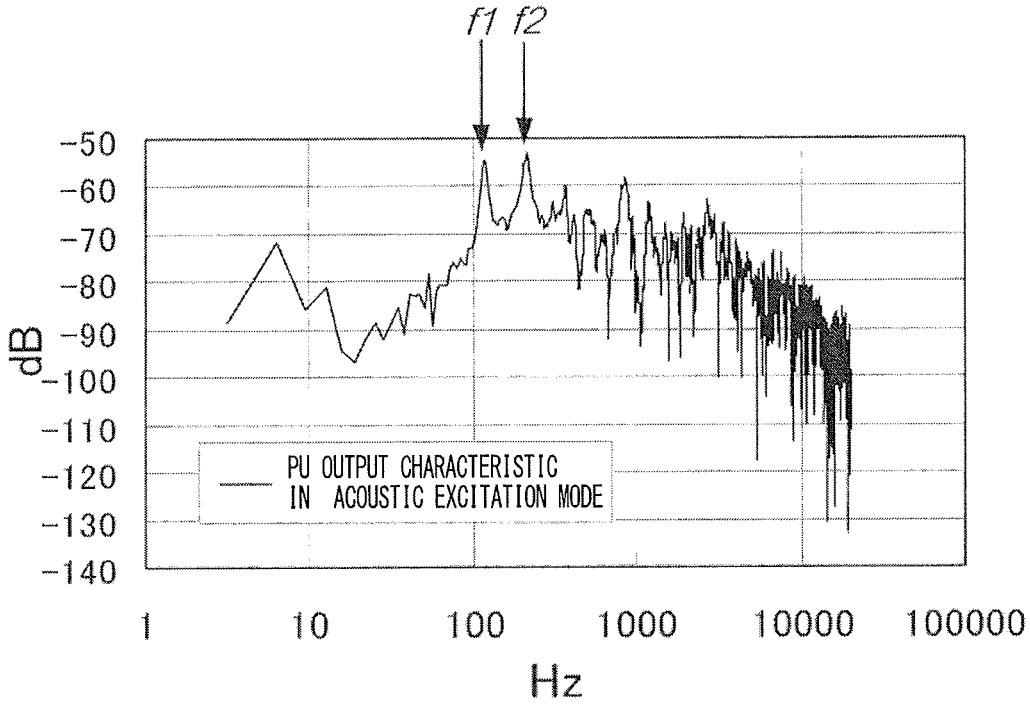
FIG. 6A is a graph showing a frequency characteristic of an audio signal which is produced by the guitar undergoing acoustic excitation of vibration due to white noise.
Figure 6B:
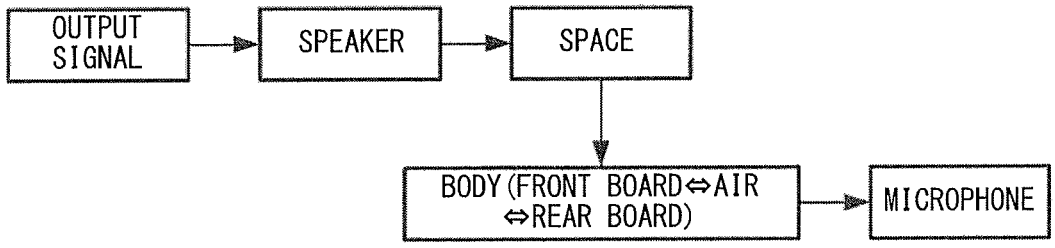
FIG. 6B is a simplified diagram showing a propagation path of white noise transmitted from a speaker to a guitar.

FIGS. 6A and 6B illustrate a transfer function which is created based on an audio signal Sin of the pickup 3 due to white noise. FIG. 6A shows a frequency characteristic of an audio signal Sin produced by the guitar 1 undergoing acoustic excitation of vibration due to white noise, and FIG. 6B shows a propagation path of white noise. Specifically, when the speaker 12 of the amplifier 10 emits white noise toward the guitar 1 via the external space (i.e. the external space surrounding the guitar 1), the pickup 3 converts vibration due to resonance of the body 4 and vibration transmitted toward the guitar 1 into an audio signal Sin. That is, the pickup 3 produces an audio signal Sin due to acoustic excitation of vibration on the guitar 1. The calculation part 112 calculates a transfer function Php(t) based on the frequency characteristic of FIG. 6A. Similar to the frequency characteristic of FIG. 5A, the frequency characteristic of FIG. 6A includes twin peaks at frequencies f1, f2, which are reflected in the transfer function Php(t). As shown in FIG. 6B, the frequency characteristic of FIG. 6A is produced via acoustic excitation of vibration without using an impulse hammer and a microphone shown in FIG. 5B, but the frequency characteristic of FIG. 6A certainly includes twin peaks at frequencies f1, f2 similar to the frequency characteristic of FIG. 5A. That is, the present embodiment is able to produce a transfer function reflecting a single peak waveform or a plurality of distinctive peak waveforms representing resonance sound which may occur in the body of an acoustic guitar without using an impulse hammer and a microphone shown in FIG. 5B. Additionally, any user of the guitar 1 is allowed to produce desired sound reflecting a resonance component by way of convolution using the transfer function.

The frequency characteristic of FIG. 6A slightly differs from the frequency characteristic of FIG. 5A in the intermediate frequency range and the high frequency range; hence, it may be difficult for any user to experience a real auditory sensation listening to the original sound of an acoustic guitar. In this aspect, any user may operate the operator 13 to adjust the EQ setting for satisfactorily correcting sound in consideration of the property of the speaker 12 and the transfer function of the external space. It is possible for any user to adjust a transfer function in advance and to store a preliminary adjusted transfer function in the memory 11. In this case, the filter 114 may utilize a preliminary adjusted transfer function, which is produced by adjusting a transfer function calculated by the calculation part 112, stored in the memory 113. Herein, the calculation part 112 does not necessarily calculate a transfer function and store it in the memory 113. In other words, the calculation part 112 may adjust the calculated transfer function so as to reproduce a natural resonance component. For example, it is possible to store a plurality of transfer functions representing sound propagation models in the memory 113, and then the calculation part 112 is allowed to adjust each one of the transfer functions stored in the memory 113.

Figure 7A:
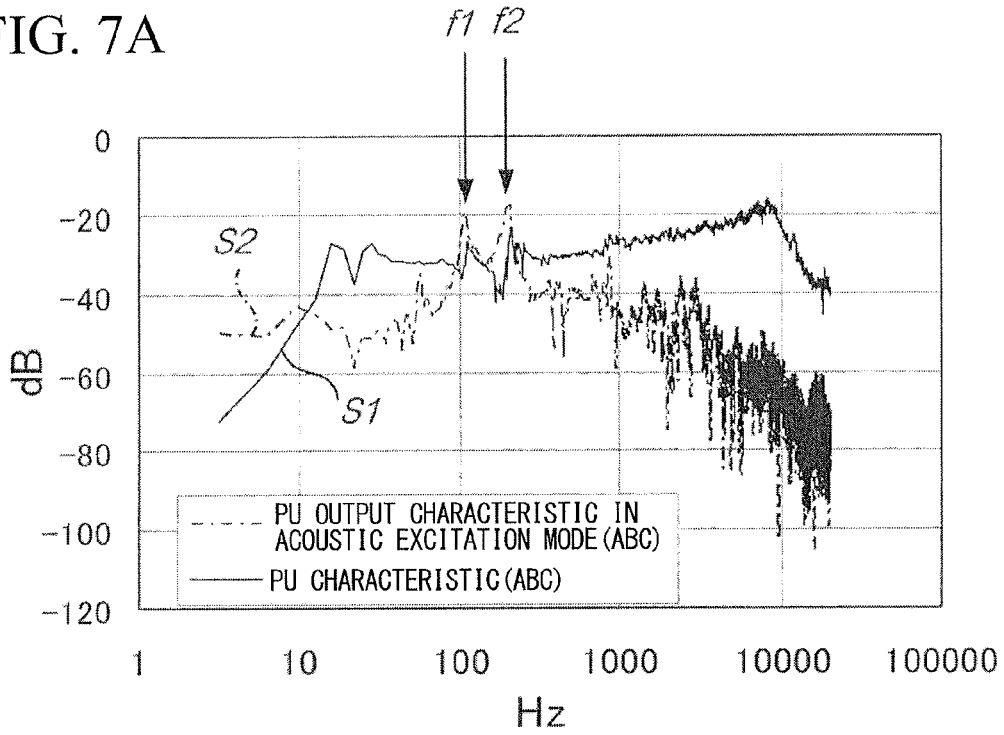
FIG. 7A is a graph showing frequency characteristics of a pickup (PU) embedded a bridge of a guitar ABC.
Figure 7B:
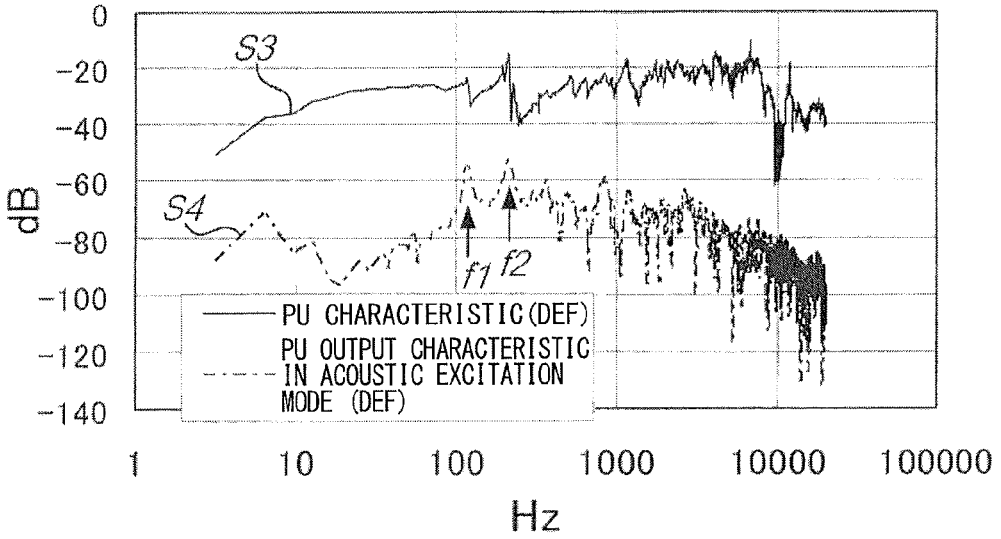
FIG. 7B is a graph showing frequency characteristics of a pickup (PU) mounted on the backside of a front board of a guitar DEF.

FIGS. 7A and 7B show differences of frequency characteristics depending on the mount position of the pickup 3 in the guitar 1. FIG. 7A shows frequency characteristics S1, S2 relating to a guitar "ABC" including a pickup (PU) embedded in a bridge, while FIG. 7B shows frequency characteristics S3, S4 relating to a guitar "DEF" including a pickup (PU) mounted on the backside of a front board. Specifically, the frequency characteristics S1, S3 of FIGS. 7A, 7B indicate fluctuations of vibration detected on the pickup 3 receiving vibration of an impulse hammer instead of acoustic excitation of vibration, while the frequency characteristics S2, S4 of FIGS. 7A, 7B indicate transfer functions when the pickup 3 produces an audio signal Sin in response to white noise, i.e. transfer functions Php(t) reflecting acoustic excitation of vibration. As shown in FIGS. 7A and 7B, the transfer functions Php(t) exhibit twin peaks at frequencies f1, 12 characterizing sound-box resonance sound irrespective of the position and the structure of a pickup embedded in a guitar. With the pickup 3 configured of a piezoelectric element, it is possible to produce a transfer function with twin peaks at frequencies f1, f2 according to the acoustic excitation technique of the present embodiment irrespective of the position and the structure of the pickup 3 in the guitar 1.

Figure 8:
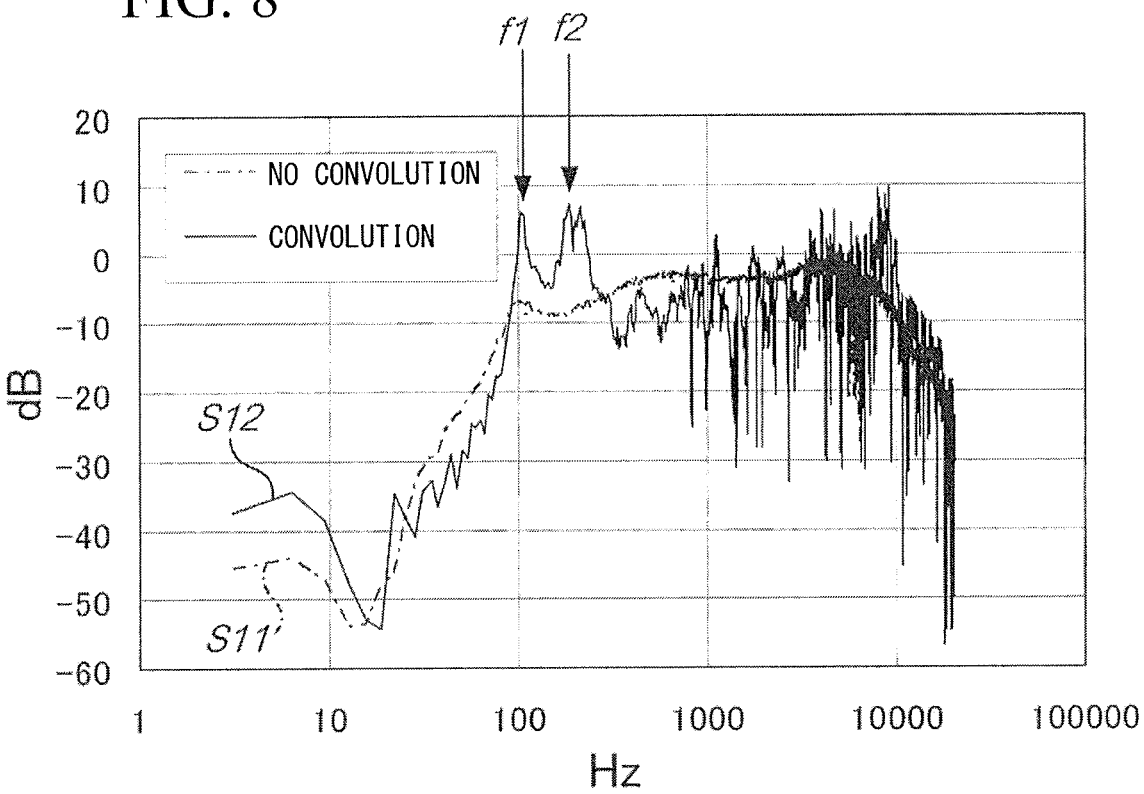
FIG. 8 is a graph showing frequency characteristics of audio signals with/without convolution.

FIG. 8 shows frequency characteristics S11, S12 of audio signals (i.e. audio data Sb output from the filter 114) with/without convolution. Specifically, the frequency characteristic (or spectrum) S11 is detected based on an audio signal Sin output from the pickup 3 detecting vibration input by an impulse hammer without convolution. The spectrum S11 without convolution does not exhibit twin peaks at frequencies f1, f2. The frequency characteristic (or spectrum) S12 is produced by performing convolution, using the transfer function Php(t) as a parameter, on the spectrum S11. FIG. 8 clearly shows that the spectrum S12 with convolution exhibits twin peaks at frequencies f1, f2. With convolution, it is possible to convert the spectrum S11 into the spectrum S12 having twin peaks at desired frequencies, not necessarily limited to frequencies f1, f2, in the entire frequency range from 20 Hz to 20 kHz.

Figure 9:
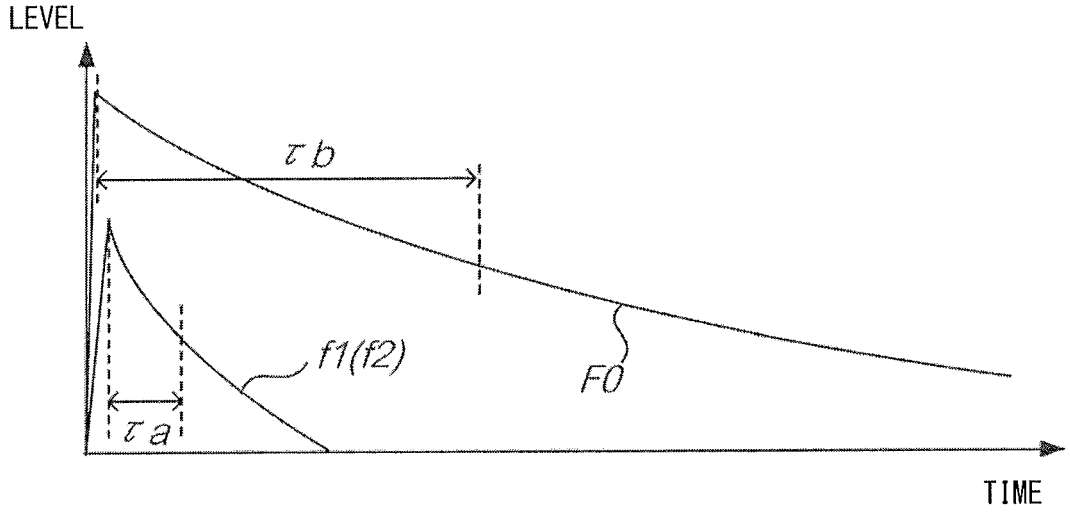
FIG. 9 is a graph showing a difference of attenuation between a peak component f1(f2), subjected to convolution, and a fundamental component FO corresponding to a fundamental tone of a string.

FIG. 9 shows a difference of attenuation between a peak component f1(f2) of audio data Sb, subjected to convolution, and a fundamental component FO corresponding to a fundamental tone of a string. Specifically, the peak component f1(f2) indicates a time-related variation of a peak portion in the spectrum S12 among frequency components of audio data Sb, while the fundamental component FO indicates a time-related variation of a fundamental tone (which appears due to vibration of a string 2) among frequency components of audio data Sb. FIG. 9 clearly shows that the peak component f1(f2) is attenuated faster than the fundamental component FO. That is, an attenuation time $\tau a$ of the peak component f1(f2) is shorter than an attenuation time $\tau b$ of the fundamental component FO. Herein, an attenuation time indicates a period of time in which a certain frequency component is attenuated from a peak value by a certain ratio of level. FIG. 8 compares the peak component f1(f2) with the fundamental component FO; but this is not a restriction. The same result can be obtained by comparing the peak component f1(f2) with other frequency components such as harmonic overtones (e.g. harmonic vibration components). It is possible to redesign the present embodiment such that an harmonic vibration components other than the peak component f1(f2) can be attenuated faster than harmonic vibration components. It is possible to determine the time-related variation of the transfer function Php(t) such that audio data Sb of the filter 114, already subjected to convolution, may achieve the attenuation characteristic of FIG. 9.

As described above, the signal processing device 11 is characterized in that the calculation part 112 calculates a transfer function based on a white-noise signal and an audio signal Sin which is output from the pickup 3 detecting vibration due to white noise applied to the guitar 1; the filter 114 performs convolution using the transfer function; then, the output part 117 produces an audio signal Sout reflecting resonance sound of the body 4 of the guitar 1 in user's played sound. The calculation part 112 calculates a transfer function exhibiting twin peaks at frequencies f1, f2 due to resonance of the body 4 of the guitar 1. Herein, the transfer function may attenuate the peak portions f1, f2 faster than the fundamental component FO, which appears in vibration of the string 2, in the convoluted audio data Sb. By performing a filtering operation according to the above transfer function on the audio signal Sin output from the guitar 1, it is possible to improve reproducibility of sound-box resonance in the body 4 of the guitar 1. Since the signal processing device 11 is arranged independently of the guitar 1, any user may use various guitars to reproduce a sound-box resonance component with ease. The present embodiment does not need impulse response analysis using an impulse hammer and a microphone in order to obtain a transfer function in advance. That is, the present embodiment allows users to determine a transfer function representing the sound-box resonance of a musical instrument's body due to acoustic excitation of vibration when processing audio signals input by a musical instrument.

Next, simulation results will be described with respect to frequency characteristics of stringed instruments (e.g. guitars), i.e. frequency distribution (or frequency profiles) of predetermined sounds.

As an example of the guitar 1, an electric acoustic guitar having six strings (i.e. string A-F having the keys of A-F), a body, and a pickup was subjected to simulation to compare frequency profiles. A microphone was used to directly receive an original sound produced by plucking a string in the key of E in an electric acoustic guitar so as to detect an original frequency profile. Additionally, frequency profiles were produced based on electric signals which were produced by the pickup and then subjected to convolution with the filter 114.

Figure 10A:
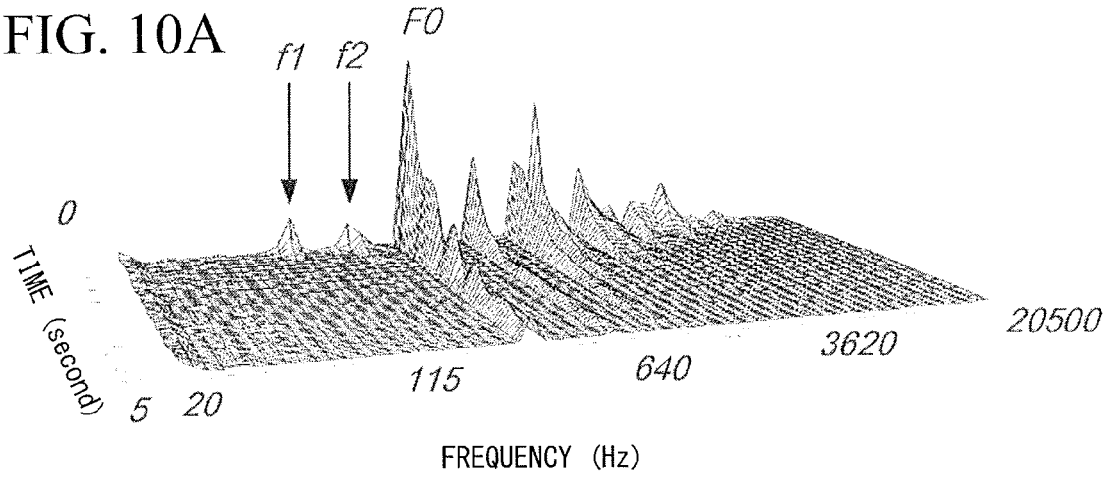
FIG. 10A is a three-dimensional graph showing an entire frequency profile including all frequency components which may appear in sound of a string E of an acoustic guitar.
Figure 10B:
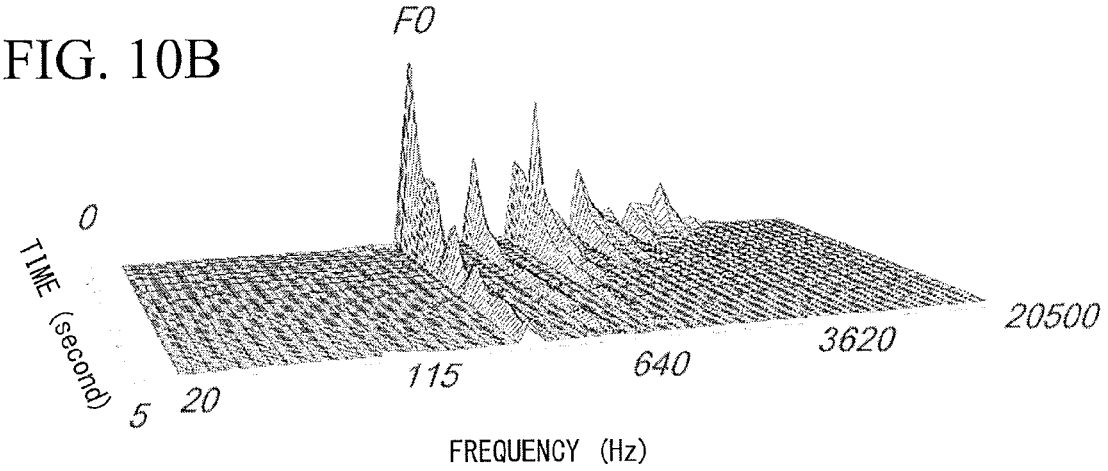
FIG. 10B is a three-dimensional graph showing a frequency profile including a fundamental component (FO) and its harmonic overtones selected from among frequency components shown in FIG. 10A.
Figure 10C:
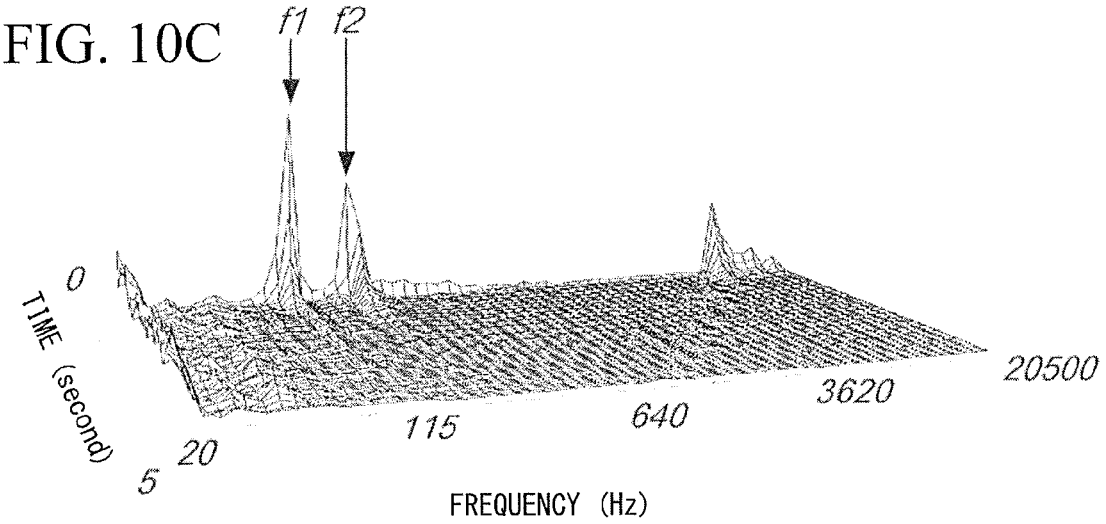
FIG. 10C is a three-dimensional graph showing a frequency profile including resonance components (f1, f2) selected from among frequency components shown in FIG. 10A.

FIGS. 10A-10C show time-related variations of frequency distribution which is produced by plucking a string E in an acoustic guitar, i.e. frequency profiles of audio signals which are produced by plucking an acoustic guitar and received with a microphone. FIGS. 10A-10C show three-dimensional graphs, in which an X-axis represents frequency, a Y-axis represents time, and a Z-axis represents a level (or an amplitude). Herein, the peaks of frequency components are appropriately adjusted (i.e. appropriately expanded/compressed) in the Z-axis; hence, the same peak of each frequency component may be illustrated differently among FIGS. 10A-10C.

FIG. 10A shows an entire frequency profile including all frequency components which may appear in the sound of a string E produced by plucking an acoustic guitar. FIG. 10B shows a frequency profile including a fundamental component (FO) and its harmonic overtones extracted from the frequency profile of FIG. 10A. FIG. 10C shows a frequency profile including resonance components (f1, f2) extracted from the frequency profile of FIG. 10A. FIG. 10C shows that distinctive peak portions f1, f2 reliably appear in the frequency profile. The entire frequency profile of FIG. 10A is made by combining the frequency profiles of FIGS. 10B and 10C.

Figure 11A:
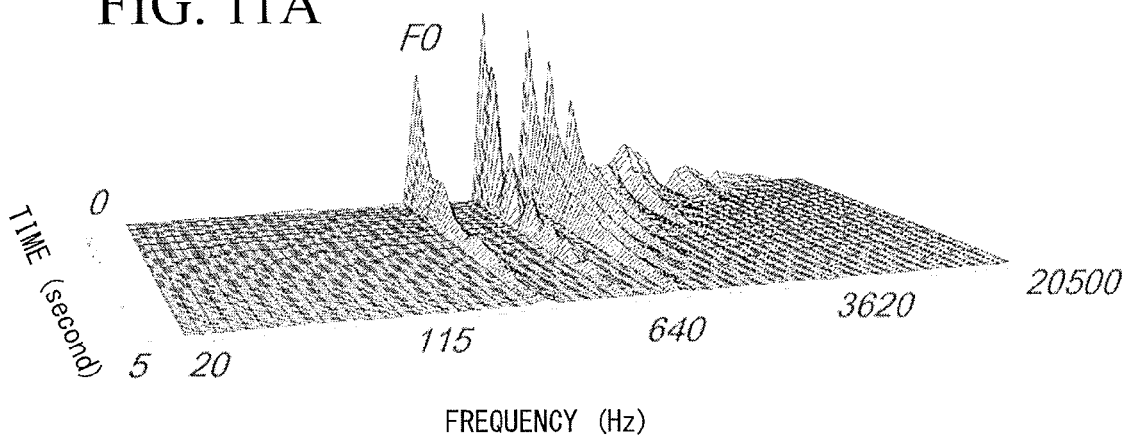
FIG. 11A is a three-dimensional graph showing an entire frequency profile including all frequency components which may appear in sound of a string E of an electric acoustic guitar.
Figure 11B:
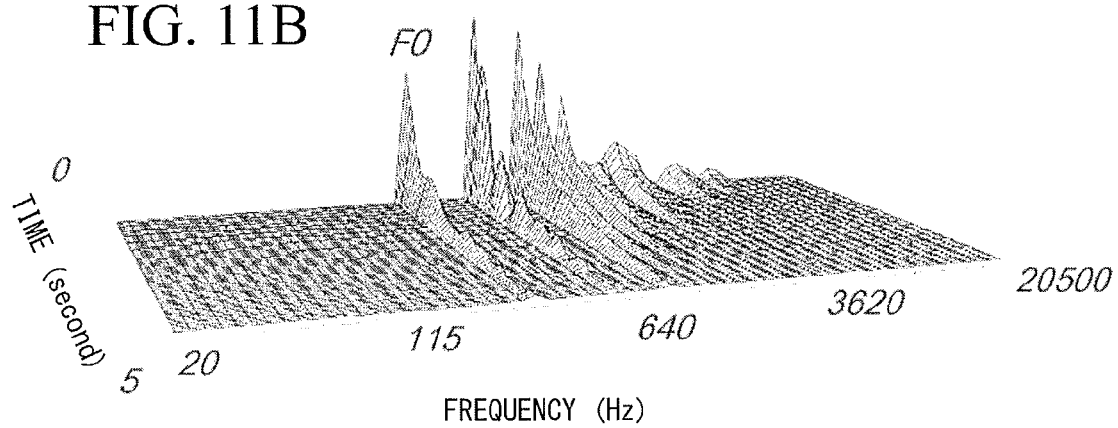
FIG. 11B is a three-dimensional graph showing a frequency profile including a fundamental component (FO) and its harmonic overtones selected from among frequency components shown in FIG. 11A.
Figure 11C:
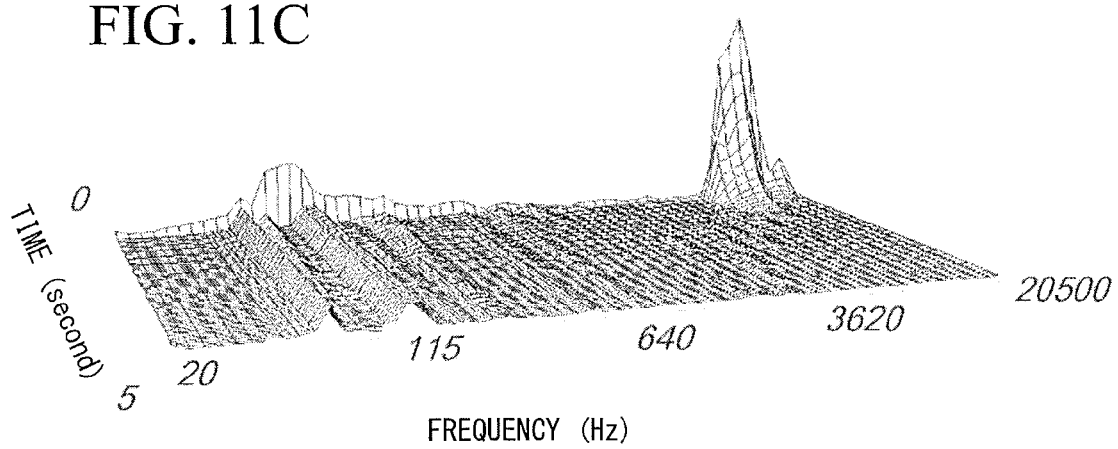
FIG. 11C is a three-dimensional graph showing a frequency profile including frequency components other than the fundamental component (FO) and its harmonic overtones selected from among frequency components shown in FIG. 11A.

FIGS. 11A-11C show time-related variations of frequency distribution which is produced by plucking a string E in an electric acoustic guitar, i.e. frequency profiles of audio signals which are produced using a pickup of an electric acoustic guitar. FIGS. 10A-10C show three-dimensional graphs, in which an X-axis represents frequency, a Y-axis represents time, and a Z-axis represents a level (or an amplitude). Herein, the peaks of frequency components are appropriately adjusted (i.e. appropriately expanded/compressed) in the Z-axis; hence, the same peak of each frequency component may be illustrated differently among FIGS. 11A-11C.

FIG. 11A shows an entire frequency profile including all frequency components which may appear in the sound of a string E produced by plucking an electric acoustic guitar. FIG. 10B shows a frequency profile including a fundamental component (FO) and its harmonic overtones extracted from the frequency profile of FIG. 11A. FIG. 11C shows a frequency profile including frequency components other than the fundamental component (FO) and its harmonic overtones extracted from the frequency profile of FIG. 11A. FIG. 11C shows that distinctive peak portions f1, f2 do not appear in the frequency profile. This is because an audio signal output from the pickup of an electric acoustic guitar depends on the frequency property of the pickup, but an audio signal of the pickup does not include sound-box resonance components. The entire frequency profile of FIG. 11A is made by combining the frequency profiles of FIGS. 11B and 11C.

Figure 12A:
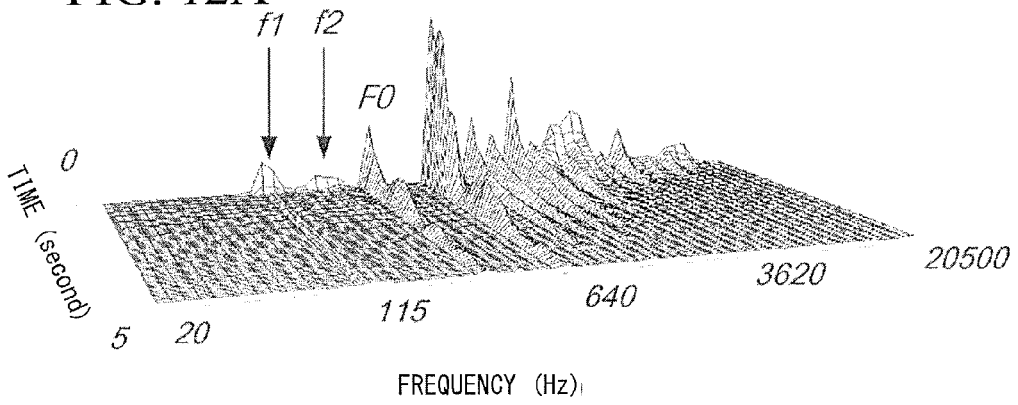
FIG. 12A is a three-dimensional graph showing an entire frequency profile including all frequency components which may appear in sound of a string E of an electric acoustic guitar with a convolution function.
Figure 12B:
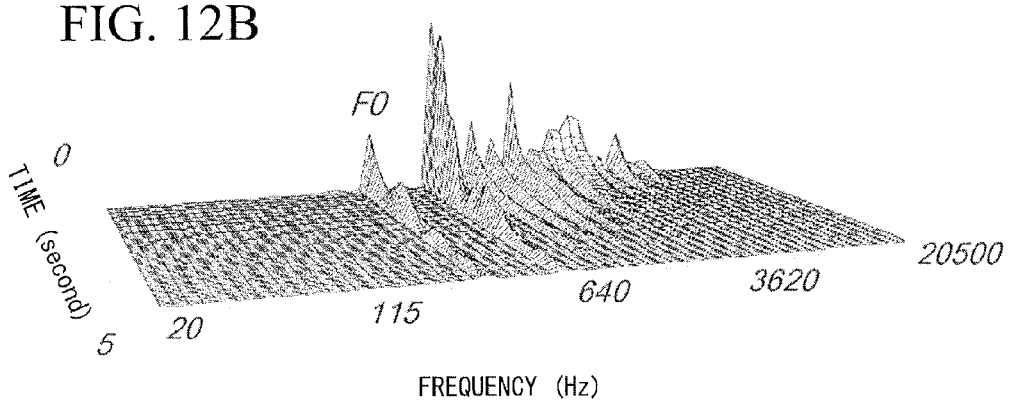
FIG. 12B is a three-dimensional graph showing a frequency profile including a fundamental component (FO) and its harmonic overtones selected from among frequency components shown in FIG. 12A.
Figure 12C:
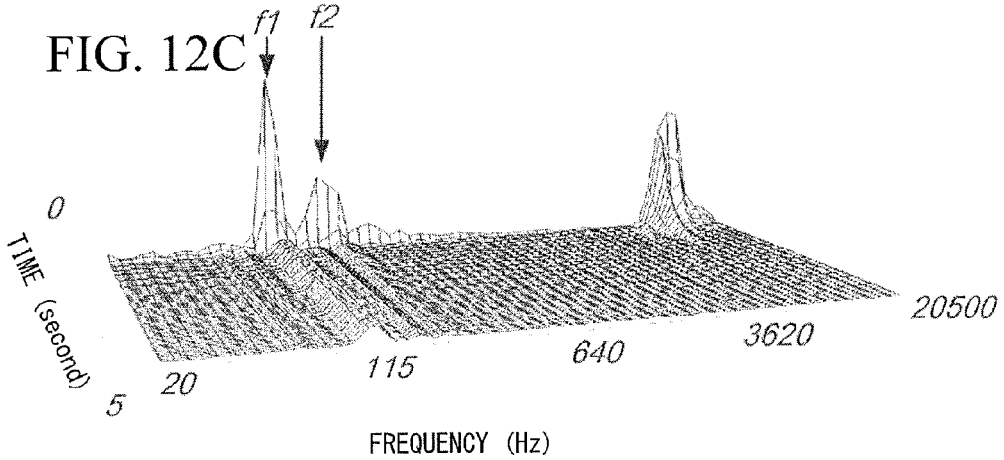
FIG. 12C is a three-dimensional graph showing a frequency profile including resonance components (f1, f2) other than the fundamental component (FO) and its harmonic overtones selected from among frequency components shown in FIG. 12A.

FIGS. 12A-12C show time-related variations of frequency distribution which is produced by an electric acoustic guitar with a convolution function according to the present embodiment, i.e. frequency profiles corresponding to audio data which is produced by convoluting an audio signal output from a pickup of an electric acoustic guitar whose string E is being plucked. That is, the frequency profiles of FIGS. 12A-12C are produced based on audio data Sb output from the filter 114 of the guitar 1 (serving as an electric acoustic guitar). The frequency profiles of FIGS. 12A-12C are comparative to the frequency profiles of FIGS. 11A-11C. Specifically, FIG. 12A shows an entire frequency profile including all frequency components which may appear in the sound of a string E produced by plucking an electric acoustic guitar. FIG. 12B shows a frequency profile including a fundamental component (FO) and its harmonic overtones extracted from the frequency profile of FIG. 12A. FIG. 12C shows a frequency profile including resonance components (f1, f2) other than the fundamental component (FO) and its harmonic overtones extracted from the frequency profile of FIG. 12A.

FIG. 12C clearly shows that the peak portions f1, f2 (as shown in FIG. 10C) certainly appear in the frequency profile. That is, it is possible to additionally cause the resonance components f1, f2 (which are distinctive peak portions as shown in FIG. 10C) by performing convolution on an audio signal Sin with the filter 114. Thus, the guitar 1 outputs an audio signal Sout which may precisely reproduce sound-box resonance of an acoustic guitar as shown in FIGS. 10A-10C.

It is possible to modify the present invention in various ways; hence, variations will be described below.

(1) First Variation

In FIG. 1, the signal processing device 11 is a part of the amplifier 10; but this is not a restriction. The signal processing device 11 needs to include an input terminal for inputting an audio signal Sin and an output terminal for outputting audio data Sb in association with the operator 13. Herein, the acquisition part 111 may serve as the input terminal, while the output part 117 may serve as the output terminal.

Figures 13, 14:
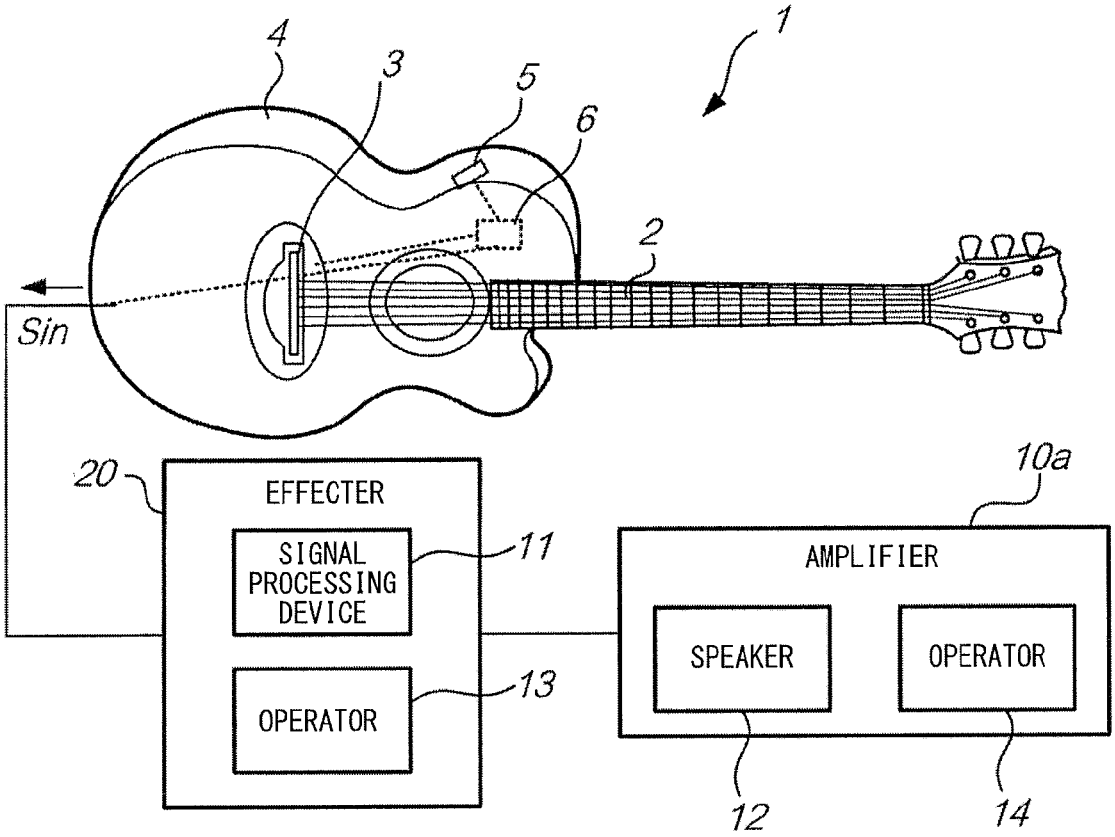
FIG. 13 is an illustration of a guitar equipped with an amplifier and an effecter according to a first variation of the embodiment.
FIG. 14 is a table describing the setting information defining the relationship between transfer functions and types of guitars.

FIG. 13 is an illustration of the guitar 1 equipped with an amplifier 10*a* and an effecter 20, wherein parts identical to those shown in FIG. 1 are denoted using the same reference signs. The amplifier 10*a* includes an operator 14 in addition to the speaker 12. The operator 14 allows a user to operate the amplifier 10*a*. The configuration of the amplifier 10*a* is similar to the configuration of the amplifier 10 except for the signal processing device 11. The effecter 20 includes the signal processing device 11 and the operator 13. The operator 13 allows a user to turn on or off a sound effect for applying a sound-box resonance component to sound actually produced by playing the guitar 1. Similar to the foregoing embodiment shown in FIGS. 1 and 2, the signal processing device 11 is designed to calculate a transfer function based on an audio signal Sin output from the pickup 3 of the guitar 1 due to white noise, and to perform convolution using the transfer function as a parameter on audio data Sa, thus producing audio data Sb reflecting a sound-box resonance component. Thus, the first variation may demonstrate the same effect as the foregoing embodiment with the signal processing device 11.

It is possible to modify the present embodiment such that a part of the constituent elements of the signal processing device 11 shown in FIG. 2 is rearranged in another device connected to the signal processing device 11. Among the constituent elements shown in FIG. 2, the memory 113, the filter 114, the EQ part 115, the transmitter 116, and the output part 117 are not necessarily included in the signal processing device 11. A part of the components 113-117 or all the components 113-117 can be rearranged in the amplifier 10*a* connected to the effecter 20 shown in FIG. 13. When the signal processing device 11 does not include the transmitter 116, the signal processing device 11 needs to acquire a white-noise signal output from the transmitter 116 or white-noise data representing the frequency characteristic of a white-noise signal for use in calculation of a transfer function with the calculation part 112. In this case, the signal processing device 11 may include memory for storing a white-noise signal or white-noise data. Alternatively, the signal processing device 11 may include an acquisition part for acquiring a white-noise signal or white-noise data output from an external device such as the effecter 20. The amplifier 10 of FIG. 1 and the effecter 20 of FIG. 13 are each designed to include the operator 13; but this is not a restriction. When the signal processing device 11 does not need to implement user's adjustment, it is possible to preclude the operator 13 from the amplifier 10 and the effecter 20.

(2) Second Variation

The foregoing embodiment refers to the guitar 1, which is an example of a musical instrument having a body (or a sound box); hence, the foregoing embodiment is applicable to other types of stringed instruments other than guitars, e.g. bowed stringed instruments such as violins. Additionally, the foregoing embodiment is applicable to string-striking musical instruments such as pianos, percussion instruments such as snare drums and floor tam-tams. These musical instruments should be equipped with transducers (or sensors) for converting vibration propagating strings or vibration occurring in drumheads into electric signals. Thus, the foregoing embodiment allows users to produce sound, reflecting sound-box resonance sound, with musical instruments including bodies (or sound boxes).

(3) Third Variation

With the signal processing device 11 including the memory 113 for storing transfer functions calculated by the calculation part 112, any user of the guitar 1 is allowed to specify a desired transfer function by simply operating the operator 13, thus implementing various sound effects. For example, it is possible for a user to play a violin (instead of the guitar 1) so as to produce an audio signal Sin while setting a transfer function, simulating sound-box resonance of a cello's body, to a parameter of the filter 114. By performing convolution using the transfer function simulating sound-box resonance of a cello, it is possible to produce an audio signal Sout reflecting the resonance sound of a cello while a user is playing a violin. Even when a user plays a none-box type stringed instrument such as an electric violin not including a resonance body (or a sound box), it is possible to apply a resonance component, representing sound-box resonance of a stringed instrument actually furnished with a resonance body, to the audio signal Sin output from the none-box type stringed instrument.

(4) Fourth Variation

It is possible to employ a specific measure for further improving the precision of convolution. The pickup 3 of the guitar 1 outputs an audio signal Sin due to white noise propagated through the path of FIG. 6B. Herein, the speaker 12 emits white noise which propagates through the external space to reach the body 4 of the guitar 1. In particular, white noise may cause vibration which is transmitted via an air layer from the front surface to the backside of the body 4 of the guitar 1, and therefore the pickup 3 detects vibration occurring in the body 4 of the guitar 1. That is, the pickup 3 may produce an audio signal Sin due to white noise via a plurality of transfer functions, the number of which may be identical to the number of factors involved in the propagation path shown in FIG. 6B. For this reason, it is necessary to calculate a transfer function regarding the speaker 12 and to recalculate the inverse function for the transfer function. By setting the inverse function of the transfer function to a parameter of convolution, it is possible to produce audio data Sb precluding an impact of the transfer function of the speaker 12. As described above, it is possible to further improve the precision of convolution by use of the inverse function for part of transfer functions involved in the propagation path of white noise or the like.

(5) Fifth Variation

It is not necessary to use transfer functions calculated by the calculation part 112. That is, it is possible to use predetermined transfer functions as parameters of convolution. Herein, the memory 113 may store the setting information as shown in FIG. 14.

FIG. 14 shows the setting information describing transfer characteristics (e.g. transfer functions) in connection with various types of guitars, wherein types G0, G1, G2, G3, G4, G5 are related to transfer functions Php(t), Bhm(t)_1, Bhm(t)_2, Bhm(t)_3, Bhm(t)_4, Bhm(t)_5. Specifically, the type G0 is related to the transfer function Php(t) representing a route in which the pickup 3 produces an audio signal Sin upon receiving vibration propagating via the strings 2 of the guitar 1 due to white noise. The transfer function Php(t) is calculated by the calculation part 112. The types G1 to G5 are each related to the transfer function Bhm(t) (i.e. Bhm(t)_1 to Bhm(t)_5) representing a route in which sound produced by at least one string of each type of guitar is subjected to sound-box resonance and the received at a predetermined reception point. The transfer function Bhm(t) is calculated by striking the bridge of a certain type of guitar is struck with an impulse hammer. Vibration caused by the impulse hammer is converted into sound, which is received by a microphone, disposed at a predetermined reception point (e.g. a certain point apart from the front side of a guitar by a certain distance), and then analyzed as impulse response. The method for calculating transfer functions is not necessarily limited to the above method using an impulse hammer; hence, it is possible to use various methods which are well known in this field of technology. The memory 113 may receive the setting information, relating to any transfer function corresponding to the type of the guitar 1 (or the type of any musical instrument), via an input/output interface, thus registering it therewith.

The filter 114 may read the transfer function Php(t) corresponding to the type G0 with reference to the setting information, thus setting it as a parameter of convolution. Additionally, the filter 114 may read the transfer function Bhm(t) corresponding to the desired type of a musical instrument, which is selected by a user operating the operator 5, with reference to the setting information, thus setting it as a parameter of convolution. For example, the signal processing device 11 may use the transfer function Php(t) as a low-register parameter of convolution while using the transfer function Bhm(t) (corresponding to the desired type of a musical instrument) as an intermediate-register parameter of convolution or a high-register parameter of convolution. This allows a user to produce desired sound ranging from an intermediate register to a high register without performing correction using the EQ part 115.

In this connection, it is possible to set at least one parameter for use in signal processing based on two or more transfer functions, for example, the transfer function Php(t) and at least one transfer function Bhm(t) which is selected from among the transfer functions Bhm(t)_1 to Bhm(t)_5.

(6) Sixth Variation

The signal processing device 11 is not necessarily equipped with the transmitter 116 for producing white noise. Instead of using the transmitter 116, it is possible to employ another measure causing acoustic excitation of vibration. For example, acoustic excitation of vibration may cause to occur when a user taps the periphery of the pickup 3 with his/her hand or when a user claps his/her hands in front of the pickup 3. That is, it is possible to calculate transfer functions by way of the tapping or hand clapping. When a user intends to cause acoustic excitation of vibration via hand clapping, the memory 113 stores an audio signal representing hand-clapping sound in advance. When a user operates the operator 13 to instruct acoustic excitation of vibration via hand clapping, the calculation part 112 reads an audio signal representing hand-clapping sound from the memory 113. The calculation part 112 calculates a transfer function based on audio data Sa and the audio signal representing the hand-clapping sound. Thus, the signal processing device 11 can demonstrate the same effect as the foregoing embodiment without using the transmitter.

Lastly, the present invention is not necessarily limited to the foregoing embodiment and its variations, which are directed to sound-box resonance of a guitar's body. However, the present invention is applicable to other types of resonance such as sound-board resonance of a piano; hence, the present invention is able to measure various resonance properties regarding any types of musical instruments without using a microphone disposed at a specific reception point. Thus, the present invention may embrace further modifications which can be created within the scope of the invention as defined in the appended claims.

What is claimed is:

1. A signal processing device comprising:

an acquire part which is configured to acquire an audio signal from a musical instrument;

a calculation part which is configured to calculate and adjust a transfer characteristic, representing a resonance characteristic of the musical instrument, based on a test signal and the audio signal which is fed back from the musical instrument receiving a test sound corresponding to the test signal, wherein the signal processing device is connected to a speaker which is configured to produce the test sound based on the test signal;

a memory configured to store a first transfer characteristic, corresponding to the transfer characteristic calculated by the calculation part, and at least one second transfer function which is measured in advance; and a parameter setting part which is configured to set a parameter based on the first transfer characteristic and the at least one second transfer characteristic read from the memory.

2. The signal processing device according to claim 1, wherein the transfer characteristic has a frequency characteristic with at least one peak component, and wherein the at least one peak component attenuates faster than a fundamental component of the audio signal.

3. The signal processing device according to claim 1, further comprising:

a filter which is configured to process the audio signal based on the parameter.

4. The signal processing device according to claim 3, wherein the filter is an FIR filter which is configured to perform convolution based on the transfer characteristic with respect to audio data which is output from the acquisition part based on the audio signal.

5. The signal processing device according to claim 3, wherein the memory is configured to store a plurality of transfer characteristics which are measured in advance, wherein the transfer characteristic read from the memory is supplied to the filter.

6. The signal processing device according to claim 1, further comprising a transmitter which is configured to produce the test signal representing the test sound emitted toward the musical instrument.

7. The signal processing device according to claim 1, wherein the musical instrument includes a vibrator causing vibration, a sound box resonating to the vibration, and a transducer which is configured to convert the vibration into the audio signal, and wherein the calculation part calculates the transfer characteristic simulating sound-box resonance of the musical instrument based on the audio signal and the test signal.

8. The signal processing device according to claim 1, wherein the test signal is a white-noise signal, and the test sound is white noise.

9. The signal processing device according to claim 1, wherein the signal processing device is further connected to the musical instrument, wherein the musical instrument is a guitar including a sound box, strings, and a pickup, and wherein the transfer characteristic is determined to reproduce distinctive peaks which appear in a low-frequency range of sound of the guitar.

10. The signal processing device according to claim 9, wherein white noise is applied to the guitar so that the pickup produces a secondary audio signal due to acoustic excitation of vibration which occurs in the guitar receiving the white noise, and wherein the secondary audio signal is mixed with a primary audio signal which is produced by playing the guitar.

11. A signal processing method comprising:

acquiring an audio signal from a musical instrument;

calculating a transfer characteristic, representing a resonance characteristic of the musical instrument, based on a test signal and the audio signal which is fed back from the musical instrument receiving a test sound corresponding to the test signal, wherein the signal processing device is connected to a speaker which is configured to produce the test sound based on the test signal;

storing a first transfer characteristic in a memory, wherein the first transfer characteristic corresponds to the transfer characteristic and at least one second transfer function which is measured in advance; and setting a parameter based on the first transfer characteristic and the at least one second transfer characteristic read from the memory.

* * * * *